US006719182B2

(12) United States Patent
Schalbetter et al.

(10) Patent No.: US 6,719,182 B2
(45) Date of Patent: Apr. 13, 2004

(54) PISTON FOR A SETTING TOOL

(75) Inventors: Dionys Schalbetter, Haag (CH); Johann Büchel, Sevelen (CH); Jürgen Bergauer, Nuziders (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/329,120

(22) Filed: Dec. 24, 2002

(65) Prior Publication Data

US 2003/0168490 A1 Sep. 11, 2003

(30) Foreign Application Priority Data

Dec. 27, 2001 (DE) ..... 101 64 202

(51) Int. Cl.[7] ..... F01B 11/02
(52) U.S. Cl. ..... 227/10; 92/169.1; 60/632
(58) Field of Search ..... 227/9, 10, 130; 92/169.1; 60/632, 637, 638

(56) References Cited

U.S. PATENT DOCUMENTS

| | | | | |
|---|---|---|---|---|
| 4,068,790 A | * | 1/1978 | Osterle et al. | 227/8 |
| 5,329,839 A | * | 7/1994 | Ehmig | 89/1.14 |
| 5,806,747 A | * | 9/1998 | Van Erden et al. | 227/10 |
| 6,059,162 A | * | 5/2000 | Popovich et al. | 227/10 |
| 6,289,789 B1 | * | 9/2001 | Heeb et al. | 92/169.1 |
| 6,547,120 B1 | * | 4/2003 | Popovich et al. | 227/10 |

* cited by examiner

*Primary Examiner*—Scott A. Smith
(74) *Attorney, Agent, or Firm*—Sidley Austin Brown & Wood, LLP

(57) ABSTRACT

A piston for a setting tool and including a piston head (10) having a hollow-chamber (12) adjoining opening (11) formed in the end surface of the piston head, and a stopper (20) securable in the hollow chamber (12) of the piston head (10) with a solder seam for closing the opening (11), a centering element (23) provided on an outer circumference of the outer surface (22) of the stopper (20).

9 Claims, 2 Drawing Sheets

PISTON FOR A SETTING TOOL

BACKGROUND OF THE INVENTION

1. Field of the Invention

The present invention relates to a piston for a setting tool and including a piston head having, in its combustion chamber-side end, an opening, and a hollow chamber adjoining the opening, and a stopper securable in the hollow chamber of the piston head with a solder seam for closing the opening.

2. Description of the Prior Art

In setting tools, a piston is displaceably supported in a hollow chamber. The piston is driven as a result of an explosive combustion of an appropriate fuel in the combustion chamber of a setting tool. With its setting direction side end, the piston engages a fastening element, which is located in a pin guide of the setting tool, and drives the fastening element into a, e.g., constructional component.

In combustion-engined setting tools, because of weight consideration, the piston is formed hollow and is closed with a stopper. The stopper is secured at the end of the piston hollow chamber by a soldering connection. In a conventional piston, it often happens that the stopper is not adequately centered. As a result, upon the soldering of the stopper in the hollow chamber, the solder seam is not uniform. The soldering connection is subjected to high loads as a result of action of high dynamic and thermal loads on the piston during the operation of the setting tool. The non-uniformity of the solder seam can lead to a premature breaking of the soldering connection and to the loss of the stopper.

Accordingly, an object of the present invention is to provide a setting tool piston in which the non-uniformity of the solder seam, which connects the stopper with the piston head, is prevented.

SUMMARY OF THE INVENTION

This and other objects of the present invention, which will become apparent hereinafter, are achieved by providing centering means on the outer surface of the stopper.

The provision of the centering means on the circumference of the outer surface of the stopper, e.g., in form of knurling or a plurality of projections insures a concentric arrangement of the stopper in the hollow chamber of the piston head and, thereby, a formation of a soldering gap around the outer circumference of the stopper and which provides, at all of the points of the stopper circumference, similar geometrical conditions for a capillar effect between the piston head and the outer circumference of the stopper. The present invention noticeably reduces amount of rejects during manufacturing of hollow pistons. Further, the present invention increases the service life of the piston as in each case, a stable soldering connection can be achieved.

According to an advantageous embodiment of the present invention, the outer diameter of the centering means, which is formed e.g., as a knurling, is somewhat greater than the inner diameter of the hollow chamber of the piston in the stopper insertion region. This insures that the stopper cannot move during the assembly and the soldering process. The present invention ensures precise and quality manufacturing of the piston resulting in a quality end product.

According to the present invention, the stopper is provided with a solder repository, which can also be formed at the opening in the piston head or in the hollow chamber of the piston head. The solder repository prevents deposition of the excess solder, during the soldering process, on the finished, continuous end surface of the stopper which, otherwise, would have to be subjected to additional treatment. The elimination of the additional treatment of the end surface of the stopper after soldering reduces manufacturing costs.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
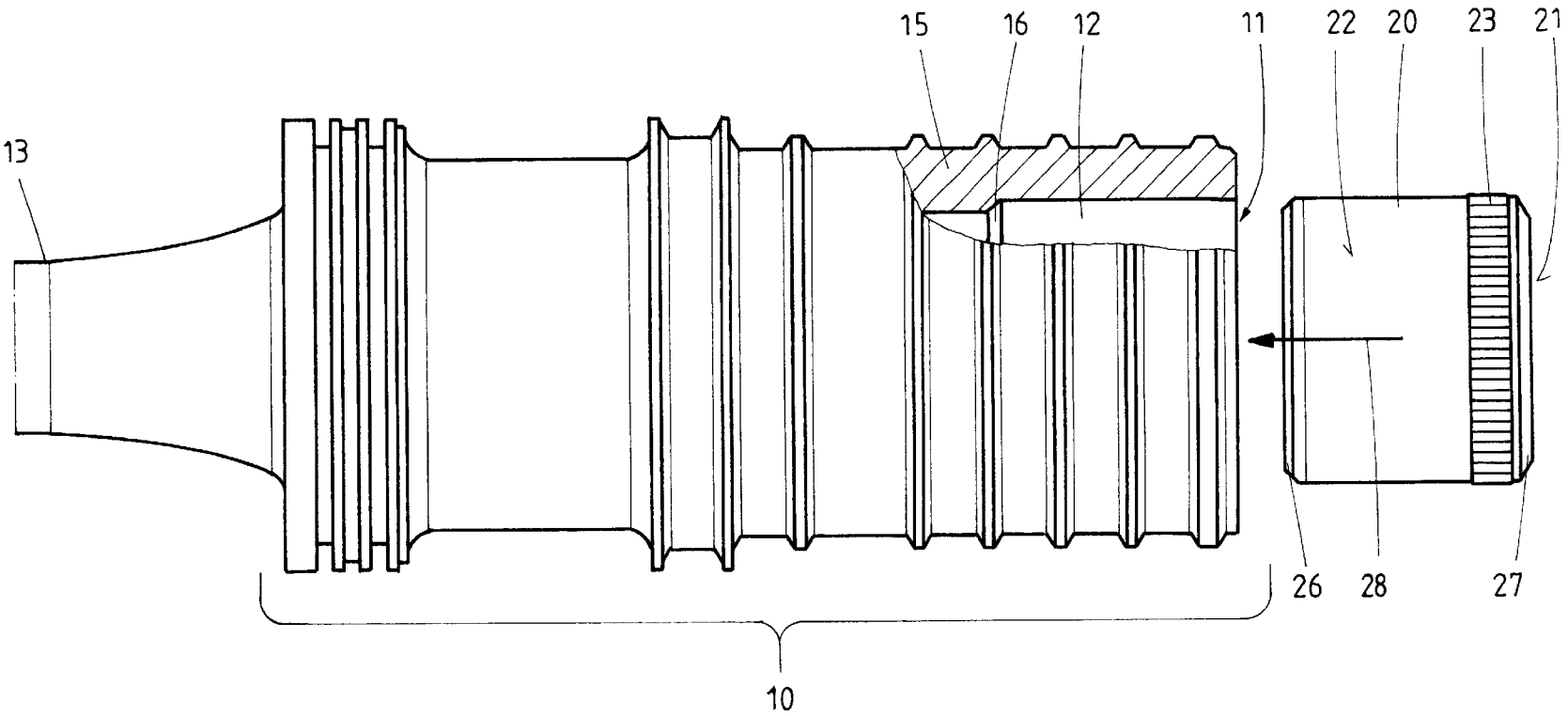
FIG. 1 shows a side, partially cross-sectional view of a piston according to the present invention with a stopper.
Figure 2:
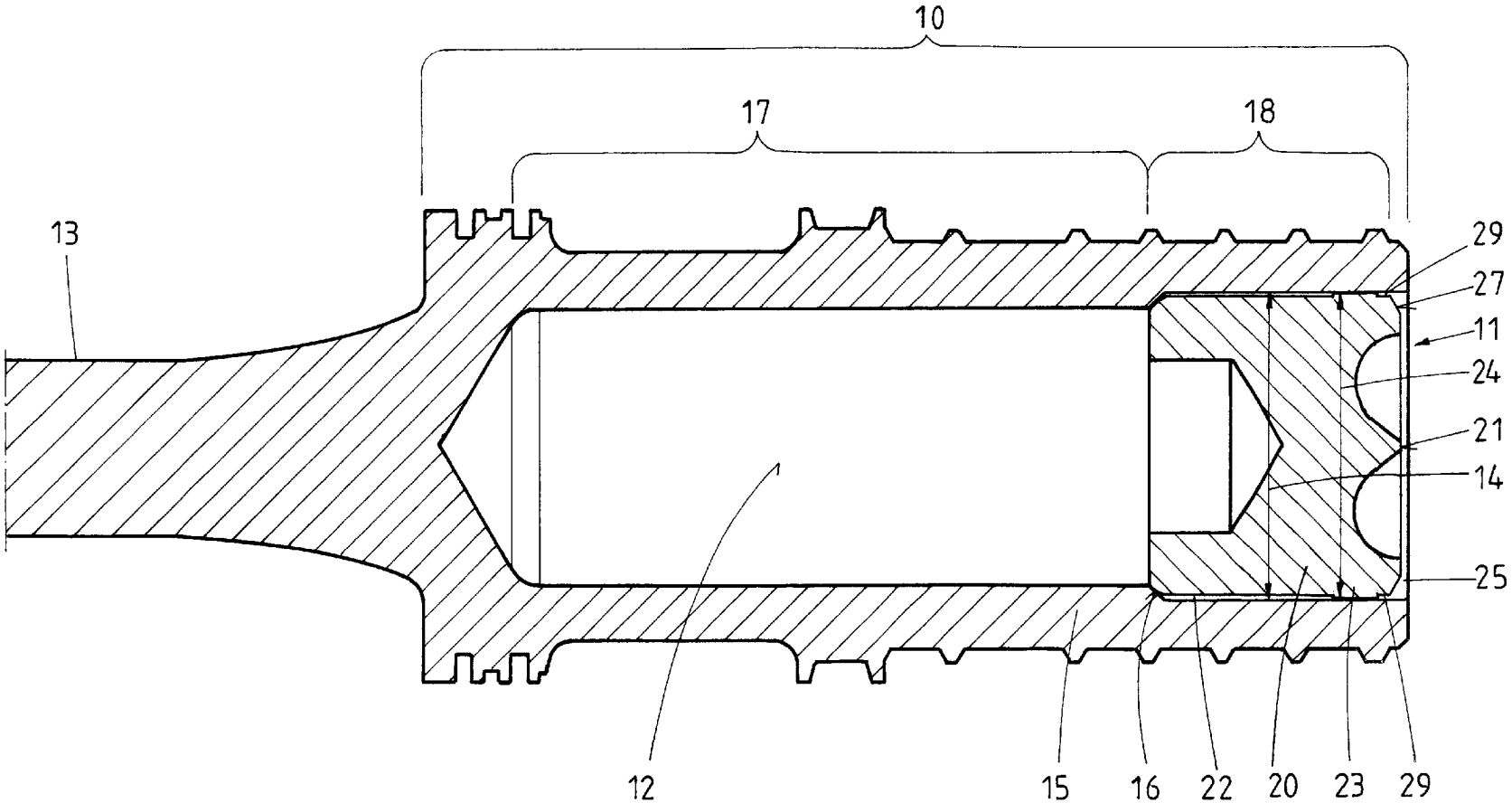
FIG. 2 a longitudinal, cross-sectional view of the piston shown in FIG. 1 with the inserted stopper.

A piston according to the present invention for a setting tool, which is shown in FIGS. 1–2, has a hollow piston head 10 and a piston skirt 13 (shown only partially). In the end side of the piston head 10, an opening 11 is formed. A hollow chamber 12 is located behind the opening 11. The hollow chamber 12 has a front region 18 and a rear region 17. The rear region 17 of the hollow chamber 12 has a smaller inner diameter than the diameter of the front region 18. In the transition region between the front region 18 and the rear region 17, the wall 15 of the piston has a conical annular surface 16.

According to the present invention, the piston has a stopper 20 having, in the embodiment shown in the drawing, a continuous end surface 21. The stopper 20 further has, in the embodiment shown in the drawings, a cylindrical outer surface 22. Outside of the outer surface 22, in the region adjacent to the outer end surface of the stopper 20, a circumferential knurling is provided. In the embodiment shown in the drawings, the outer diameter 24 of the stopper 20 in the region of the knurling 23 is greater than the inner diameter 14 of the hollow chamber 12 in the region of the opening 11 in the front region 18. During the assembly of the piston, the stopper 20 is inserted in the front region 18 of the piston by being displaced in the direction shown with arrow 28. The stopper 20 is insertable into the hollow chamber 12 until a conical annular surface 26, that adjoins the outer surface 22 of the stopper, engages the conical annular surface 16 provided in the wall 15 of the piston. The knurling 23 insures a precise uniform distribution of a solder gap 29 between the outer surface 22 of the stopper 20 and the piston wall 15. In the embodiment shown in the drawings, the solder gap 29 has, e.g., a width of 0.1 mm with a tolerance of +/−0.02 to 0.05 mm. The knurling 23 has a height of 0.15 mm above of the outer surface 22. The difference of 0.05 mm between the height of the knurling 23 and the solder gap 29 provides for a press fitting of the stopper 20 in the hollow chamber 12 of the piston. Thereby, an inadvertent displacement of the stopper 20 in the hollow chamber 12 of the piston head 10 during a soldering process is prevented. The soldering seam, which insures securing of the stopper 20 in the hollow chamber 12 of the piston head 10, is not shown in the drawings.

Conveniently, a solder repository 24 is provided on the stopper 20. The repository 25 is formed by an inter space between a conical annular surface 27 in the region of the end surface 21 of the stopper 20 and the piston wall 15 in the region of the opening 11 in the end surface of the piston. In the repository 25, an excess solder can accumulate during the soldering process, so that it would not flow along the end surface 21 of the stopper 20. This simplifies the assembly of the piston, as a solder on the outer end surface of a stopper should be remove by a subsequent manufacturing process.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A piston for a setting tool, comprising a piston head (10) having, in a combustion chamber-side end thereof, an opening (11) and a hollow chamber (12) adjoining the opening (11); and a stopper (20) securable in the hollow chamber (12) of the piston head (10) with a solder seam for closing the opening (11) and having an end surface (21), an outer surface (22), outgoing from the end surface (21), and centering means (23) provided on an outer circumference of the outer surface (22) of the stopper (20).

2. A piston according to claim 1, wherein the centering means (23) comprises a knurling.

3. A piston according to claim 1, wherein an outer diameter (24) of the stopper (20) at the centering means (23) is greater than an inner diameter (14) of the hollow chamber (12) of the piston head (10) in a region of the opening (11).

4. A piston according to claim 3, wherein the outer diameter (24) of the stopper (20) at the entering means (23) is by tenths of mm greater than the inner diameter (24) of the hollow chamber (12).

5. A piston according to claim 1, wherein the stopper (20) has a solder repository (25).

6. A piston according to claim 5, wherein the solder repository (25) is provided in a transition region between the end surface (21) and the outer surface (22).

7. A piston according to claim 1, wherein the piston head (10) has solder repository-defining means provided at one of the opening (11) and the hollow chamber (12) thereof.

8. A piston according to claim 1, wherein the hollow chamber (12) of the piston head (10) has a front region (18) adjoining the opening (11), a rear region (17), and a transition region (16) provided between the front (18) and rear (17) regions and formed by an conical annular surface (16), and wherein an inner diameter of the hollow chamber (12) in the front region (18) is greater than the inner diameter of the hollow chamber (12) in the rear region (17).

9. A piston according to claim 8, wherein the conical annular surface (16) limits an insertion depth of the stopper (20) in the hollow space (12) of the piston head (10).

* * * * *